US005961178A

United States Patent [19]

Hodson

[11] Patent Number: 5,961,178

[45] Date of Patent: Oct. 5, 1999

[54] PORTABLE CHAIR WITH INTEGRAL STORAGE CASE

[76] Inventor: James M. Hodson, Wilton, Conn. 06897

[21] Appl. No.: 09/098,665

[22] Filed: Jun. 17, 1998

[51] Int. Cl.[6] ..... A47C 4/00

[52] U.S. Cl. ..... 297/17; 297/16.1; 297/45

[58] Field of Search ..... 297/17, 16.2, 16.1, 297/42, 45, 51, 440.11, 440.1, 440.13, 440.16, 440.21

[56] References Cited

U.S. PATENT DOCUMENTS

| | | | |
|---|---|---|---|
| 1,738,473 | 12/1929 | Green | 297/45 |
| 3,376,069 | 4/1968 | Lowdermilk | 297/17 X |
| 4,541,666 | 9/1985 | Vanderminden | 297/16.1 |
| 5,433,502 | 7/1995 | Condorodis et al. | 297/17 |

FOREIGN PATENT DOCUMENTS

| | | | |
|---|---|---|---|
| 26861 | 10/1883 | Germany | 297/17 |

*Primary Examiner*—Laurie K. Cranmer
*Attorney, Agent, or Firm*—Perman & Green, LLP

[57] ABSTRACT

A lightweight collapsible compact chair with back support and elevation off the ground is provided by first and second substantially rigid hollow elongated members, and a flexible seat having opposite ends attached respectively to each of said first and second members. First and second vertical posts are provided and each has a lower end portion which is connectable to one of said first and second members. A flexible back is provided having opposite ends each connected respectively to one of said first and second vertical posts. A mechanism is provided for connecting said first and second members together to cause the flexible seat to become outstretched and for mounting said first and second posts to said one of said first and second members. The chair thus collapses by removal of the interlocking posts from the one of the first and second members, followed by an accordion-like compaction of the firsts and second members, to store all the components in a compact elongated casing with an optional shoulder strap.

7 Claims, 6 Drawing Sheets

PORTABLE CHAIR WITH INTEGRAL STORAGE CASE

FIELD OF INVENTION

The present invention relates to portable folding chairs and in particular to a folding chair which is integrally stored in an elongated casing said casing being an integral member of the chair when unfolded.

BACKGROUND

A lightweight, easily transportable, multiple purpose recreational chair, is highly desired It is not unusual for consumers to have various chairs to address stadium and bleacher use, beach use, camping use, and general purpose outdoor activity. Depending upon requirements, such as distance, one must carry a chair, or whether transporting the chair by bicycle, car or other means, or space allowed for each individual, such as limitations imposed for outdoor concerts or bleachers, or the surface upon which a chair will be placed, there are a wide variety of issues to consider when choosing a portable chair. It is therefore generally preferred to have a lightweight chair, which is easy to set up or break down, which consumes a minimal amount of storage space, can maintain the seat of the user in a position that is off of the ground and provides support to the back.

From a manufacturers perspective, a complex portable chair with a large number of components renders solutions which are generally more susceptible to failure. It is therefore desirable to minimize the complexity of a folding chair, or to incorporate those components which require a degree of complexity or are of multiple function into an easily producable molded or cast part.

While simpler portable solutions do exist, they provide very little bearing surface area where the chair contacts the ground, and correspondingly are poor candidates for use on soft ground such as the beach. It is therefore desirable to construct a chair which uses a large footprint area to avoid sinking into softer ground or sand.

Furthermore, the introduction of sand and grit into the coupling and braces of the removable tubes of the prior art cited complicates the set up or break down procedure by rendering the removable tubular components susceptible to binding. To avoid the effect of the binding of the removable tubes, larger tolerances must be allotted for, and consequently, a loss of stability is often the result.

In addition to the aforementioned shortcomings, none of the references cited thus far provide an integral means for transport. Any additional bag used for this purpose further adds to the cost of the product, and is subject to being lost or blown away when the chair is in use. It is also desirable for a surface to be visible at all times for the incorporation of promotional designs, however this feature can be improved upon so that visibility of a promotional logo or insignia can be achieved from a greater number of viewing positions.

Accordingly, it is an object of the invention to provide a folding chair with integral transportation casing which is easy to transport in a hands-free fashion.

It is therefore an object to construct a portable chair which uses a breakdown scheme which is not adversely affected by sand or grit getting into the joints, couplings, or folding mechanisms. Features allowing the accomplishment of this object include a chair back and folding seat which fit inside a transportation casing, and a strap which allows the transportation casing to be carried over the shoulder. In addition, the folding chair with integral transportation casing is intended to be light and compact (the entire folding chair is with integral transportation casing weighs under 4 pounds; the transportation casing measures approximately 4 inches in diameter and 24 inches in length). Advantages associated with the accomplishment of this object include the ability to carry more items per trip, the reduction of the number of trips which must be made, convenience, and ease of transporting the folding chair with integral transportation casing.

Another object of this invention is to provide a folding chair with integral transportation casing which will last a long time. Features enabling the accomplishment of this object include the use of high quality, corrosion-resistant materials such as recycled plastic and aluminum, and an easily replaceable seat back and seat bottom. Advantages associated with the achievement of this object include long term cost savings and convenience.

Still another object of this invention is to provide a folding chair with integral transportation casing which does not require excessive packaging, floor, or shelf space for point of purchase displays. Features allowing this object to be accomplished include self-contained cylindrical packaging (the transportation casing) which may bear vivid and colorful descriptive markings, and transportation tubes which are stackable. Advantages associated with the accomplishment of this include preservation of packaging materials such as plastics, cardboard, and foam plastic. Further advantage is the minimization of inventory size and shelf space in retail establishments.

Another object of this invention is to provide a folding chair with integral transportation casing resistant to transportation damage. Features permitting this object to be achieved include a base and folding seat which fit inside a protective transportation casing. Advantages include a more durable chair which is less susceptible to damage when stored or stacked.

Still another object of this invention is to provide a folding chair with integral transportation casing resistant to carrying container loss. A feature which allows this object to be accomplished is a transportation casing integral to the assembled chair. As the transportation casing forms part of the assembled chair, it is prevented from being blown away or otherwise lost, providing the advantages of convenience and cost savings.

Another object of this invention is to provide a folding chair with integral transportation casing whose seat bottom does not rest on the ground, thereby affording the advantage of keeping its occupant dry and comfortable even in the presence of wet ground.

Another object of this invention is to provide a folding chair which can safely rest on a bleacher seat and maintain the seat bottom above the bleacher itself.

Advantages associated with the accomplishment of this object include keeping its occupant dry when a bleacher is wet, a greater comfort level when sitting on bleachers, and back support when sitting on bleachers.

Still a further object of this invention is to provide a folding chair with integral transportation casing which will not sink into soft sand by virtue of features such as a base transportation casing to provide a wide area support footprint. Advantages associated with the accomplishment of this object include comfort and convenience.

Still a further object of this invention is to provide a folding chair with integral transportation casing which resists being blown down in the presence of wind. A feature allowing this object to be accomplished is the inclusion of a transportation casing as a seat support which minimizes the amount of wind that can get under the seat. Advantages associated with the accomplishment of this object include a more stable seat when not being sat upon and lessen the hazard of a seat flying away on a breezy day.

Further objects of this invention include providing a folding chair with integral transportation casing which lends itself readily to the promotion of cylindrical item, sets up quickly, is aesthetically pleasing.

Still a further object of this invention is to provide a folding chair which incorporates structural strength and complexity into fewest possible components. Features allowing this object to be accomplished are the inclusion of a transportation casing as a seat support, joint brace, and optionally a latching mechanism and shoulder strap connector. One or more of these features can be incorporated into one part of moderate complexity such as a molded plastic component. Advantages associated with the accomplishment of this object include a lower part count, less cost, and richer features.

Still a further object of this invention is to provide a folding chair which resistant to part loss. Features allowing this object to be accomplished are the interconnection of parts. Advantages associated with the accomplishment of this object include usability and convenience.

Still a further object of this invention is to provide a folding chair which is resistant to grit and sand in joints. Features allowing this object to be accomplished are the design of the interlocking members which do not require tight tolerances to achieve a stable chair assembly. Another advantage associated with the accomplishment of this object include ease of assembly and longer chair life.

Still a further object of this invention is to provide a folding chair which provides a curved surface for rocking backward. A feature allowing this object to be accomplished is use of the outer transportation casing surface as a base support member. Advantages associated with the accomplishment of this object include greater comfort and stability.

Still a further object of this invention is to provide a folding chair which provides a curved surface to relieve the transition on bottom side of the occupant's legs. A feature allowing this object to be accomplished is use of the outer transportation casing surface as a base support member. Advantages associated with the accomplishment of this object include greater comfort.

Still a further object of this invention is to provide a folding chair which provides a backrest which does not require a horizontal structural component across it's top. A feature allowing this object to be accomplished is use of the rigid vertical upright members which are fixedly held in place by the integral transportation casing base. Advantages associated with the accomplishment of this object include greater comfort and fewer parts.

SUMMARY OF THE INVENTION

A lightweight collapsible compact chair with back support and elevation off the ground is provided by first and second substantially hollow elongated members, and a flexible seat having opposite ends attached respectively to each of said first and second members. First and second vertical posts are provided and each has a lower end portion which is connectable to one of said first and second members. A flexible back is provided having opposite ends each connected respectively to one of said first and second vertical posts. A mechanism is provided for connecting said first and second members together to cause the flexible seat to become outstretched and for mounting said first and second posts to said one of said first and second members. The chair thus collapses by removal of the interlocking posts from the one of the first and second members, followed by an accordion-like compaction of the firsts and second members, to store all the components in a compact elongated casing with an optional shoulder strap.

DETAILED DESCRIPTION OF THE PREFERRED EMBODIMENT

The invention, together with the other objects, features, aspects and advantages thereof will be more clearly understood from the following in conjunction with the accompanying drawings.

Figure 1:
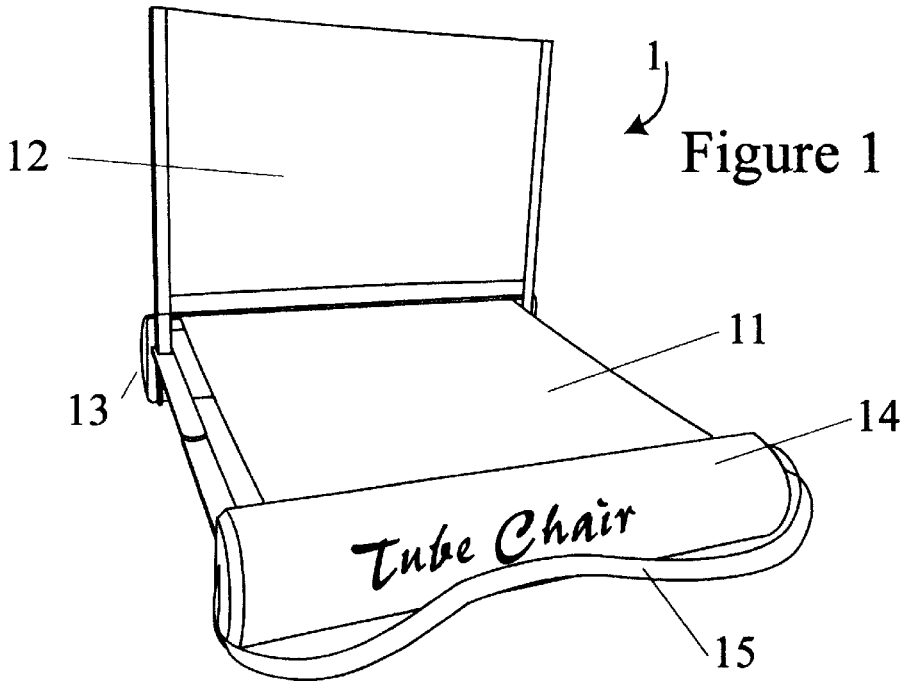
FIG. 1 is an isometric front view of the assembled folding chair with a split integral transportation case.
Figure 2:
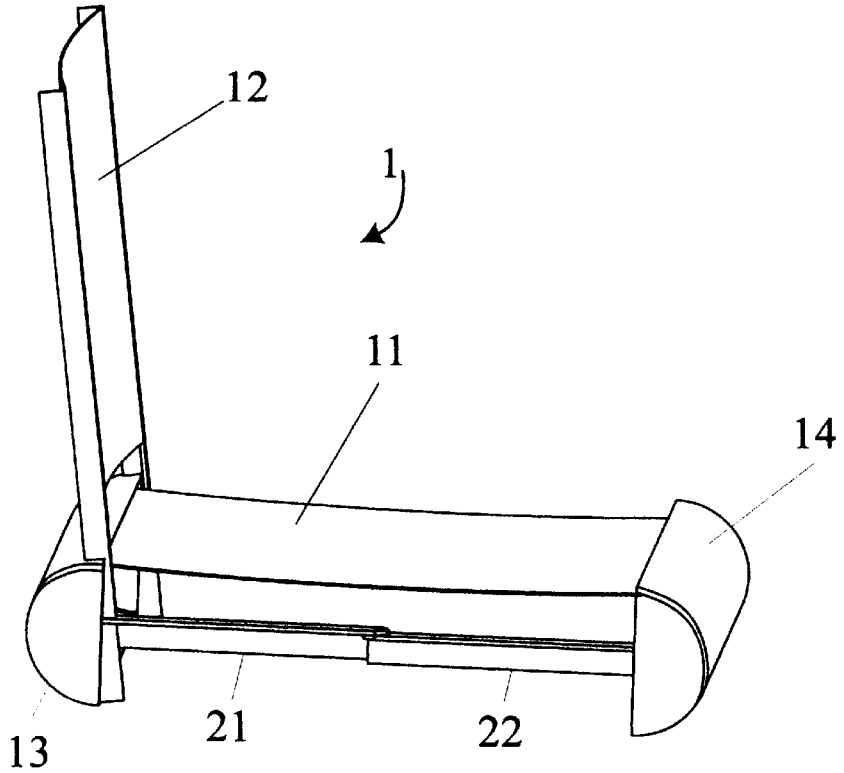
FIG. 2 is an isometric side view of the assembled folding chair with a split integral transportation case.

Referring to FIG. 1 a front isometric view of the folding chair I is shown revealing a bottom 11, backrest 12, a split integral transportation casing defined by substantially rigid casing halves 13 and 14, and shoulder strap 15. As shown, the chair I is in the fully assembled state. In FIG. 2 showing the side isometric view of the folding chair 1, it should be seen that the chair bottom 11 spans the split integral transportation casing 13 and 14. In the opened condition of this figure, the chair is supported by a pair of collapsing side struts 21,22 and 23,24 which are each comprised of two links pivotally connected to one another and at the free ends thereof to each casing half 13 and 14, respectively. As will become apparent later, the opposite ends of the struts associated with each casing halve 13 and 14 each has an pivot opening 5 ( see, FIG. 13) which allows each strut to be pivotally connected to one of the casing halves 13 and 14, respectively. In addition to this, the end of each link which connects to the casing half 13 further includes an elongated slot 3 for removable connection of the vertical posts 31 and 32. Alternative to side struts 21,22 and 23,24, a single side strut can provide equivalent function for a trade off of assembly convenience. The structural parts are preferably formed from aluminum, but substitution of aluminum, with galvanized steel, plastic, or composite materials for any of the structural members is also possible.

Figure 3:
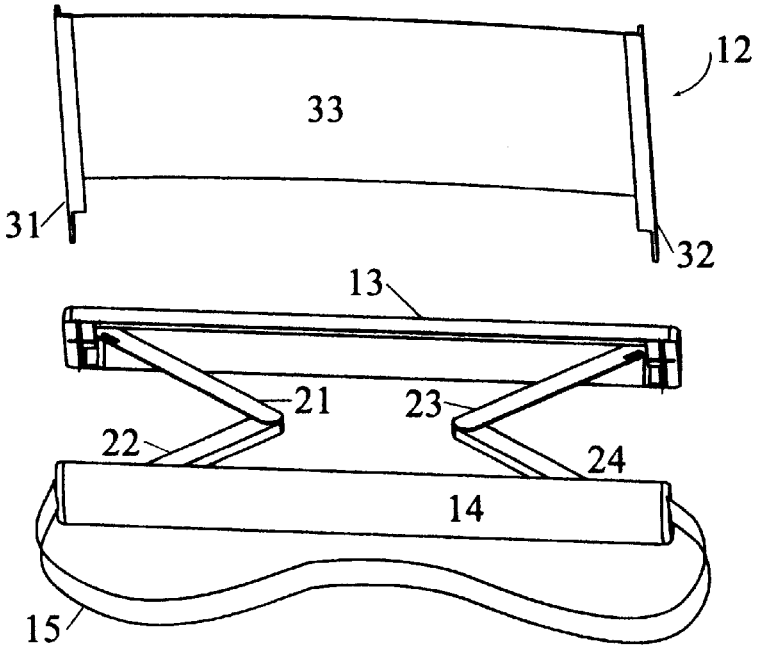
FIG. 3 is an isometric top view of the partially assembled folding chair with a split integral transportation case; the backrest subassembly is disassembled and freely resting on top.
Figure 4:
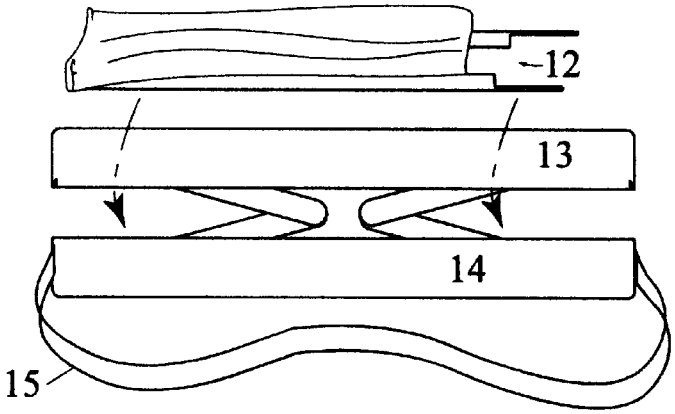
FIG. 4 is an isometric bottom view of the partially assembled folding chair with a split integral transportation case; the backrest subassembly is not shown and the collapsing strut components are shown approximately halfway actuated.

Referring to FIG. 3, it should be seen that the backrest 12 is comprised of two post members 31 and 32 and a fabric web 33 sewn about the post members to create the support. As seen in FIG. 4, the post members can be readily removed from corresponding slots in the back casing part 13 as will be discussed in greater detail later. As illustrated, the folding chair bottom 11 with the backrest 12 removed, the side struts 21 and 23 no longer are in support and the split integral transportation casing 13 and 14 can be collapsed. Each casing part is a partially hollow member providing an internal confine for storing the collapsed struts 21 and 22 and the backrest 12. Thus, the backrest 12 and its two vertical posts 31 and 32, and a fabric seat back 33 can be easily stored within the hollow confines of the casing parts 13 and 14 along with the struts 21,22 and 23,24 which become folded in a scissor-like manner.

Figure 5:
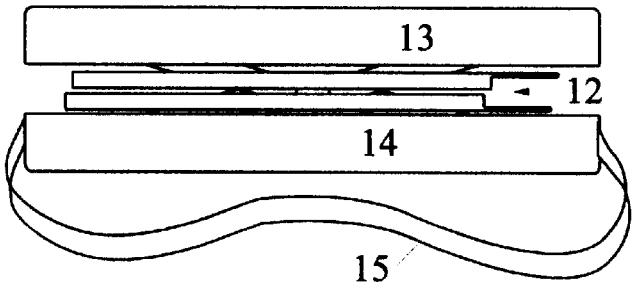
FIG. 5 is an isometric bottom view of the partially assembled folding chair with a split integral transportation case; the backrest is rolled up and placed within the confines of the transportation case and the collapsing strut components are shown close to their fully stored positions.
Figure 6:
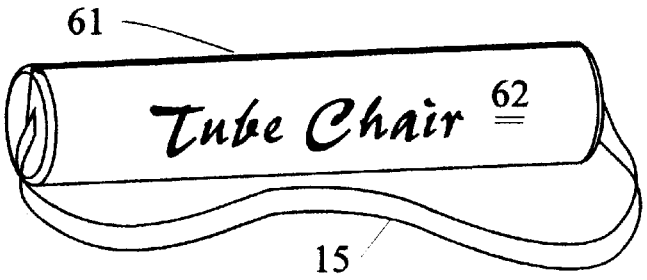
FIG. 6 is an isometric top view of the folding chair in the split integral transportation case.

FIGS. 4, 5 and 6 show the sequence of steps by which the chair 1 goes from a rigid supporting structure to a compact cylinder. It is noted that while not shown, the casing halves 13 and 14 are provided with a conventional locking means, such as a latch device disposed on the ends of the casing halves to lock the casing parts together as shown in FIG. 6. In this condition, the compacted chair 1 can now be carried away using the shoulder strap 15 in the manner illustrated in FIG. 7. Another aspect of the invention is apparent from FIG. 6 wherein it is shown areas 61 (on the rear side of the casing) and 62 are available for marking for promotional, advertising, or logo use.

Figure 12:
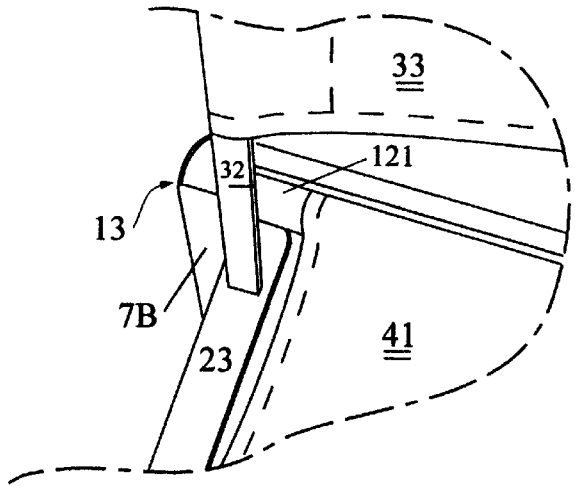
FIG. 12 is an isometric top view close up of the rear joint assembly with the backrest support member inserted and the seat and backrest fabric in place.

Referring for the moment to FIG. 12, it should be seen that the chair seat 11 is provided as a fabric seat bottom 41 wrapped around horizontal fabric tubular support member 121 which is fixed between two end blocks 7,7 which defined the length of the casing part 13. The support member 121 which transverses the end blocks 7,7 adds further rigidity to the involved casing half by providing a spacing function between each end block 7,7 of each casing half thus allowing the casing skin 9 (see FIG. 10) to be made thinner.

Referring now to FIGS. 10–13, and to an isometric top view of the back casing part 13 and the joint assembly which holds the chair in its assembled condition, it should be seen that in its open state, without the backrest vertical posts 31, 32 inserted into opening 3 of the side strut 23, the chair is not a rigid structure. However, it is through the insertion of the vertical posts 31, 32 into a vertically extending slot formed in the end blocks 7,7 of each casing part 13 and 14 that the structure becomes rigid.

Figure 13:
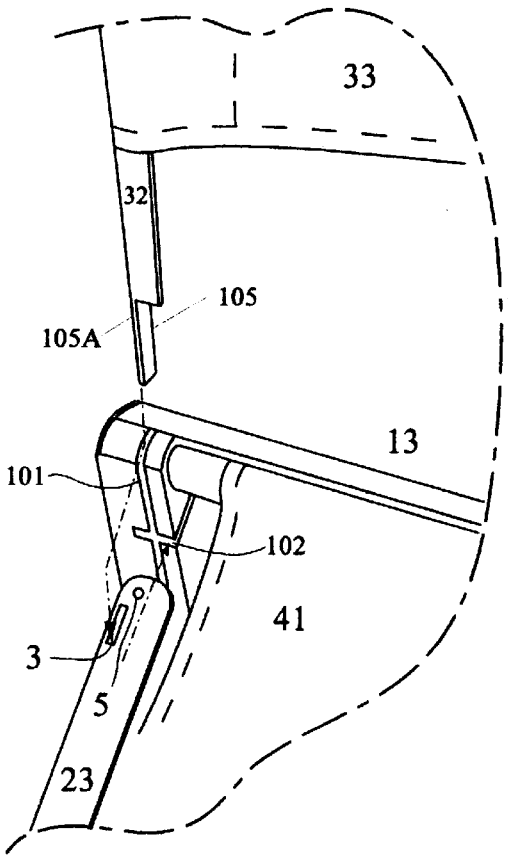
FIG. 13 is a partially fragmentary perspective view of the rear joint assembly with the back rest support member shown in its pulled out condition.

As seen in FIG. 13, each of the vertical posts 31 and 32 is has a generally L-shaped configuration as seen from one end looking along its length. However, there is formed at the lower end of each of the posts 31 and 32 a cutout 105 which eliminates the portion of each post which faces forwardly, leaving only a portion 105A which extends in parallel to the flat side 7*a* of the end block 7,7.

Figure 10:
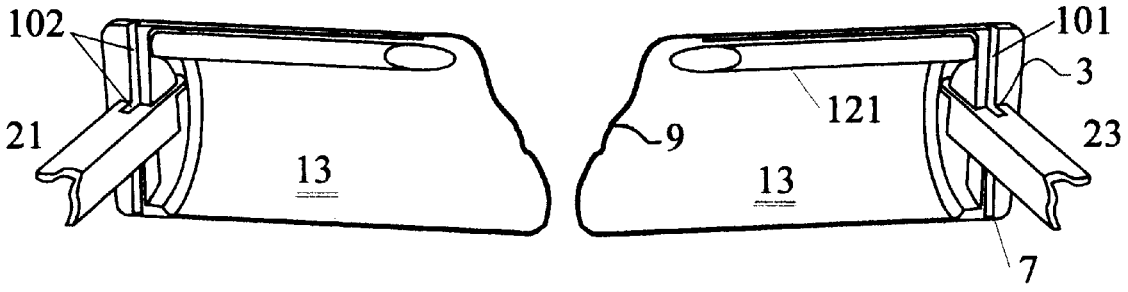
FIG. 10 is an isometric top view close up of the rear joint assembly without the backrest support member inserted.

Formed in the front face 7B of each of the end blocks 7,7 is a cruciform slot defined by a vertically extending slot 101 and an intersecting horizontally extending slot 102. The horizontally extending slot as seen in FIG. 10 is cut sufficiently through the block 7 in order to allow the end of each strut sufficient room to pivot therewith. Also, the pivot pin for each strut associated with the casing part 13 is drilled through the end blocks 7,7 to meet the pivot opening 5 in the strut parts 21 and 23 such that when the strut is fully extended, the slot 3 is in substantial alignment with the vertically extending slot 101 in the block 7.

The length of the end portion 105A is sufficiently long to extend downwardly from through the slot 101 and into the elongated opening 3 in the strut parts 21 and 23. Thus, as each side strut 21 and 23 is rotated to the open state position, a the portion 105*a* of the posts 31 and 32 can be dropped into the slot 101 and into locking relationship with the elongated opening 3 in the struts. As seen in FIG. 10 the intersection of the slots 101 and 102 provides support surfaces for both lateral stability for the end portions 105A as well as angular securement. Since the web of the end portion 105A is sufficiently long, the placement of the forward end of the elongated slot 3 can be made slightly forward of the forward end of the end face 7B in order to allow a slight angle for the back of the person to enjoy.

Figure 9:
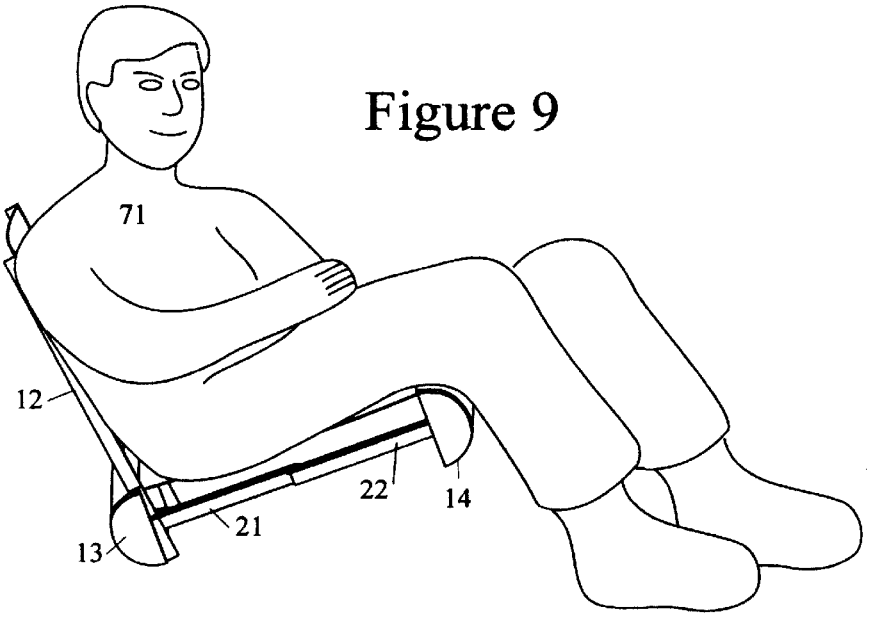
FIG. 9 is a view of the folding chair it's open state being rocked rearward on the wide bearing surface by a subject.
Figure 11:
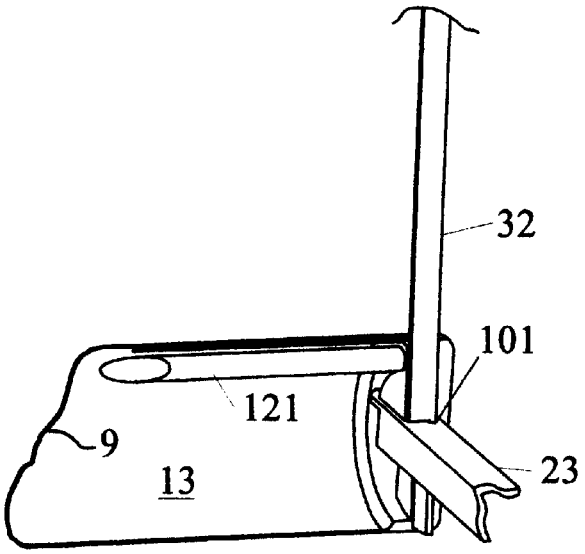
FIG. 11 is an isometric top view close up of the rear joint assembly with the backrest support member inserted.

Thus, as seen in FIG. 11, with the backrest posts 31 and 32 inserted into side struts 21 and 23, as well as into slots 101 in the end blocks 7,7, each vertical post prevents a side strut 21 and 23 from freely rotating within the casing 13 thus providing a rigid relationship between all of the aforementioned structural members. Furthermore, because each vertical post 31 and 32 is constrained within slot 101 of the integral transportation casing 13, a rigid joint is formed thereby allowing the backrest subassembly 12 not to require a horizontal member thereby saving space, weight, and cost. Thus, the assembled chair as seen in FIG. 9, even allows a subject 71 a support sufficiently strong to rock backward in outer surface of the casing 13 in a manner typical for low sitting chairs.

Figure 7:
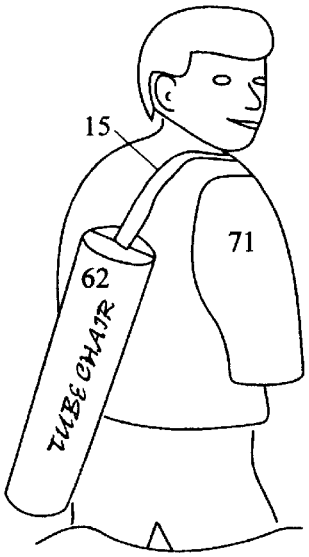
FIG. 7 is a view of the folding chair in the split integral transportation case being transported over the shoulder of a subject.
Figure 8:
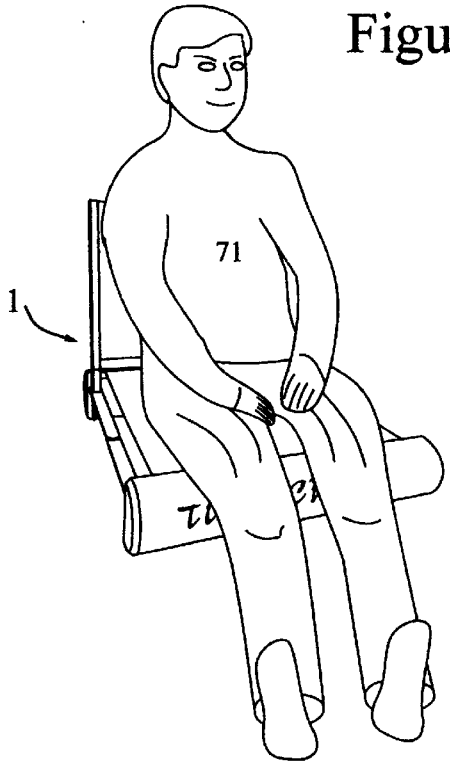
FIG. 8 is a view of the folding chair in it's open state being used by a subject.

A typical use or operation of this invention would encompass a subject 71 of FIG. 7 carrying the folding chair over his shoulder to the place of use. Upon setting it down on the ground or bleacher surface, the chair would be in the state as depicted in FIG. 6. The two halves of the split integral transportation casing 13 and 14 are held together using any of several common fastening methods such as snaps, clips or the like, which can alternatively be molded or stamped into split integral transportation casing 13 and 14. Upon release of the snapping or latch mechanism, halves 13 and 14 are pulled apart far enough to extract the backrest 12. As split integral transportation casing 13 and 14 are further pulled apart, side struts 21, 22, 23, and 24, pivot in a scissors like manner about pivot points on each of the casing parts 13 and 14 until fully extended and straight as sequentially depicted through FIGS. 4 and 3 respectively. Concurrently, seat bottom fabric 41 is fully stretched. The unfolding action of the side struts allow for an outward pull to be asserted at the pivoting joint to accomplish a high degree of tension to be imparted upon the fabric seat bottom 41. This feature is significant since a tightly stretched fabric offers more reliable support to the person sitting in the chair. The entire chair bottom fabric sling would not rest on the ground or bleacher seat.

In the event that the portable chair is rested on a bleacher seat, the assembly is supported on side support members 21, 22, 23, and 24. Split integral transportation casing 13 and 14 create an overhang which restrains the forward or rear motion of the assembled chair unit from sliding too far forward or backward off of a bleacher seat. This provides a significant safety advantage when using a folding chair for bleacher seat. The backrest 12 is then unraveled and vertical struts 31 and 32 are inserted into their respective slots or orifices in split integral transportation casing 13. Vertical struts 31 and 32 further extend through side support members 21 and 23, to lock said side support members into a position wherein they can no longer collapse inward. The chair is then ready for use. The storage of the folding chair with a split integral transportation casing is achieve by reversing the aforementioned process.

While the preferred embodiment of the invention has been illustrated herein, it is to be understood that changes and variations may be made by those skilled in the art without departing from the spirit of the invention. For example, a known variation may include the substitution of each the folding side struts with a single member or include the substitution of each the folding side struts with a series of telescoping members. Likewise, another known variation may include the substitution of a vertical strut member with one of differing cross sectional characteristics such as round, square, or rectangular tubing. Also, another variation may include the incorporation of an adjusting mechanism into split integral transportation casing 13 and 14 to achieve a tilting feature for the backrest.

Thus, the invention has been described by way of illustration rather than limitation.

I claim:

1. A collapsible chair comprising:

first and second substantially rigid hollow elongated members;

a flexible seat having opposite ends attached respectively to each of said first and second members;

first and second vertical posts each having a lower end portion which is connectable to one of said first and second members, a flexible back having opposite ends each connected respectively to one of said first and second vertical posts;

means for connecting said first and second members together to cause the flexible seat to become outstretched and for mounting said first and second posts to said one of said first and second members, and wherein said means for connecting said first and second members together includes struts each having free ends pivotally connected with one end of said first and second members.

2. A collapsible chair as defined in claim 1 further characterized by said means for connecting said first and second members further includes a cruciform slot formed in the ends of said first and second members.

3. A collapsible chair as defined in claim 4, further characterized by said cruciform slot including a vertically oriented portion and an intersecting horizontally disposed portion, and said free ends of said struts being located within said horizontally disposed portions and said lower end portions of said vertical posts being located within said vertically disposed portions.

4. A collapsible chair as defined in claim 3, further characterized by said free ends of said struts which are located in said cruciform slot further include an elongated slot for receiving said lower end portions of said vertical posts.

5. A collapsible chair as defined in claim 4, further characterized by said vertical posts having a generally L-shaped configuration and the lower end portions thereof being cut-out to define a length which extends parallel to the vertically disposed portion of the cruciform slot.

6. A collapsible chair as defined in claim 1, further characterized by said substantially rigid hollow elongated members each being formed from a pair of end blocks connected together by an elongated transverse support member and a casing skin.

7. A collapsible chair as defined in claim 6, further characterized by said flexible seat member being connected to the transverse support member of each elongated member.

* * * * *